US006259795B1

(12) United States Patent
McGrath

(10) Patent No.: US 6,259,795 B1
(45) **Date of Patent: *Jul. 10, 2001**

(54) METHODS AND APPARATUS FOR PROCESSING SPATIALIZED AUDIO

(75) Inventor: David Stanley McGrath, Bondi (AU)

(73) Assignee: Lake DSP Pty Ltd., Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 08/893,848

(22) Filed: Jul. 11, 1997

(30) Foreign Application Priority Data

Jul. 12, 1996 (AU) ..... PO0996

(51) Int. Cl.[7] ..... H04R 5/00
(52) U.S. Cl. ..... 381/310; 381/311; 381/18
(58) Field of Search ..... 381/17, 18, 19, 381/20, 309, 310, 26, 311

(56) References Cited

U.S. PATENT DOCUMENTS 5,583,942 * 12/1996 Va Den Berg ..... 381/26
5,757,927 * 5/1998 Gerzon et al. ..... 381/20
5,844,816 * 12/1998 Inanaga et al. ..... 364/565
6,021,206 * 2/2000 McGrath ..... 381/310

* cited by examiner

*Primary Examiner*—Forester W. Isen
*Assistant Examiner*—Brian Tyrone Pendleton
(74) *Attorney, Agent, or Firm*—Fulwider, Patton, Lee & Utecht

(57) ABSTRACT

A method for distribution multiple users of a soundfield having positional spatial components is disclosed including inputting a soundfield signal having the desired positional spatial components in a standard reference frame; applying at least one head related transfer function to each spatial component to produce a series of transmission signals; transmitting the transmission signals to the multiple users; for each of the multiple users, determining a current orientation of a current user and producing a current orientation signal indicative thereof; utilising the current orientation signal to mix the transmission signals so as to produce sound emission source output signals for playback to the user. The soundfield signal can comprise a B-format signal which is suitably processed.

11 Claims, 13 Drawing Sheets

METHODS AND APPARATUS FOR PROCESSING SPATIALIZED AUDIO

FIELD OF THE INVENTION

The present invention relates to the field of audio processing and in particular, to the creation of an audio environment for multiple users wherein it is designed to give each user an illusion of sound (or sounds) located in space.

BACKGROUND OF THE INVENTION

U.S. Pat. No. 3,962,543 by Blauert et. al discloses a single user system to locate a mono sound input at a predetermined location in space. The Blauert et. al. specification applies to individual monophonic sound signals only and does not include any reverberation response and hence, although it may be possible to locate a sound at a radial position, due to the lack of reverberation response, no sound field is provided and no perception of distance of a sound object is possible. Further, it is doubtful that the Blauert et. al. disclosure could be adapted to a multi-user environment and in any event does not disclose the utilisation of sound field signals in a multi-user environment but rather one or more monophonic sound signals only.

U.S. Pat. No. 5,596,644 by Abel et al. describes a way of presenting a 3D sound to a listener by using a discrete set of filters with pre-mixing or post-mixing of the filter inputs or outputs so as to achieve arbitrary location of sounds around a listener. The patent relies on a break-down of the Head Related Transfer Functions (HRTFs) of a typical listener, into a number of main components (using the well known technique of Principal Component Analysis). Any single sound event may be made to appear to come from any direction by filtering it through these component filters and then summing the filters together, with the weighing of each filter being varied to provide an overall summed response that approximates the desired HRTF. Abel et. al. does not allow for the input to be represented as a soundfield with full spatial information pre-encoded (rather than as a collection of single, dry, sources) and to manipulate the mixing of the filters before or after the filters to simulate headtracking. Neither of these benefits are obtained by the Abel et. al.

Thus, there is a general need for a simple system for the creation of an audio environment for multiple users wherein it is designed to give each user an illusion of sound (or sounds) located in space.

SUMMARY OF THE INVENTION

It is an object of the present invention to provide for an efficient and effective method of transmission of sound field signals to multiple users.

In accordance with the first aspect of the present invention there is provided a method for distribution to multiple users of a soundfield having positional spatial components, said method comprising the steps of:

inputting a soundfield signal having the desired positional spatial components in a standard reference frame;

applying at least one head related transfer function to each spatial component to produce a series of transmission signals;

transmitting said transmission signals to said multiple users;

for each of said multiple users:

determining a current orientation of a current user and producing a current orientation signal indicative thereof;

utilising said current orientation signal to mix said transmission signals so as to produce sound emission source output signals for playback to said user.

Preferably, the soundfield signal includes a B-format signal and said applying step comprises:

applying a head related transfer signal to the B-format X component signal said head related transfer signal being for a standard listener listening to the X component signal; and applying a head related transfer signal to the B-format Y component signal said head related transfer signal being for a standard listener listening to the Y component signal;

Preferably, the output signals of said applying step can include the following:

XX : X input subjected to the finite impulse response for the head transfer function of X XY: X input subjected to the finite impulse response for the head transfer function of Y;

YY: Y input subjected to the finite impulse response for the head transfer function of Y;

YX: Y input subjected to the finite impulse response for the head transfer function of X;

The mix can include producing differential and common mode components signals from said transmission signals.

Preferably, applying step is extended to the Z component of the B-format signal.

In accordance with a third aspect of the present invention there is provided a method for reproducing sound for multiple listeners, each of said listeners able to substantially hear a first predetermined number of sound emission sources, said method comprising the steps of:

inputting a sound field signal;

determining a desired apparent source position of said sound information signal.

for each of said multiple listeners, determining a current position of corresponding said first predetermined number of sound emission sources; and manipulating and outputting said sound information signal so that, for each of said multiple listeners, said sound information signal appears to be sourced at said desired apparent source position, independent of movement of said sound emission sources.

Preferably, the manipulating and outputting step further comprises the steps of:

determining a decoding function for a sound at said current source position for a second predetermined number of virtual sound emission sources;

determining a head transfer function from each of the virtual sound emission sources to each ear of a prospective listener;

combining said decoding functions and said head transfer functions to form a net transfer function for a second group of virtual sound emission sources when placed at predetermined positions to each ear of an expected listener of said second group of virtual sound emission sources;

applying said net transfer function to said sound information signal to produce a virtually positioned sound information signal;

for each of said multiple listeners, independently determining an activity mapping from said second group of virtual sound emission sources to said current source position of said sound information signal and applying said mapping to said sound information signal to produce said output.

In accordance with the fourth aspect of the present invention there is provided a sound format for utilisation in an apparatus for sound reproduction, including a direction component indicative of the direction from which a particular sound has come from, said directional component having been subjected to a head related transfer function.

In accordance with the fifth aspect of the present invention there is provided a sound format for utilisation in an apparatus for sound reproduction, said sound format created via the steps of:

determining a current sound source position for each sound to be reproduced;

applying a predetermined head transfer function to each of said sounds, said head transfer function being an expected mapping of said sound to each ear of a prospective listener when each ear has a predetermined orientation.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF THE PREFERRED AND OTHER EMBODIMENTS

In order to obtain a proper understanding of the preferred embodiments which are directed to a multi-user system, it is necessary to first consider the operation of a single user system.

In discussion of the embodiments of the present invention, it is assumed that the input sound has a three dimensional characteristics and is in an "ambisonic B-format". It should be noted however that the present invention is not limited thereto and can be readily extended to other formats such as SQ, QS, UMX, CD-4, Dolby MP, Dolby surround AC-3, Dolby Pro-logic, Lucas Film THX etc.

The ambisonic B-format system is a very high quality sound positioning system which operates by breaking down the directionality of the sound into spherical harmonic components termed W, X, Y and Z. The ambisonic system is then designed to utilise all output speakers to cooperatively recreate the original directional components.

For a description of the B-format system, reference is made to:

(1) The Internet ambisonic surround sound EAQ available at the following HTTP locations.
http://www.omg.unb.ca/~mleese/
http://www.york.ac.uk/inst/mustech/3d_audio/ambison.htm
http://jrusby.uoregon.adu/mustech.htm The FAQ is also available via anonymous FTP from pacific.cs.unb.ca in a directory /pub/ambisonic. The FAQ is also periodically posted to the Usenet newsgroups mega.audio.tech, rec.audio.pro, rec.audio.misc, rec.audio.opinion.

(2) "General method of theory of auditory localisation", by Michael A Gerzon, 90 sec, Audio Engineering Society Convention, Vienna Mar. 24th–27th 1992.

(3) "Surround Sound Physco Acoustics", M. A. Gerzon, Wireless World, December 1974, pages 483–486.

(4) U.S. Pat. Nos. 4,081,606 and 4,086,433.

Figure 1:
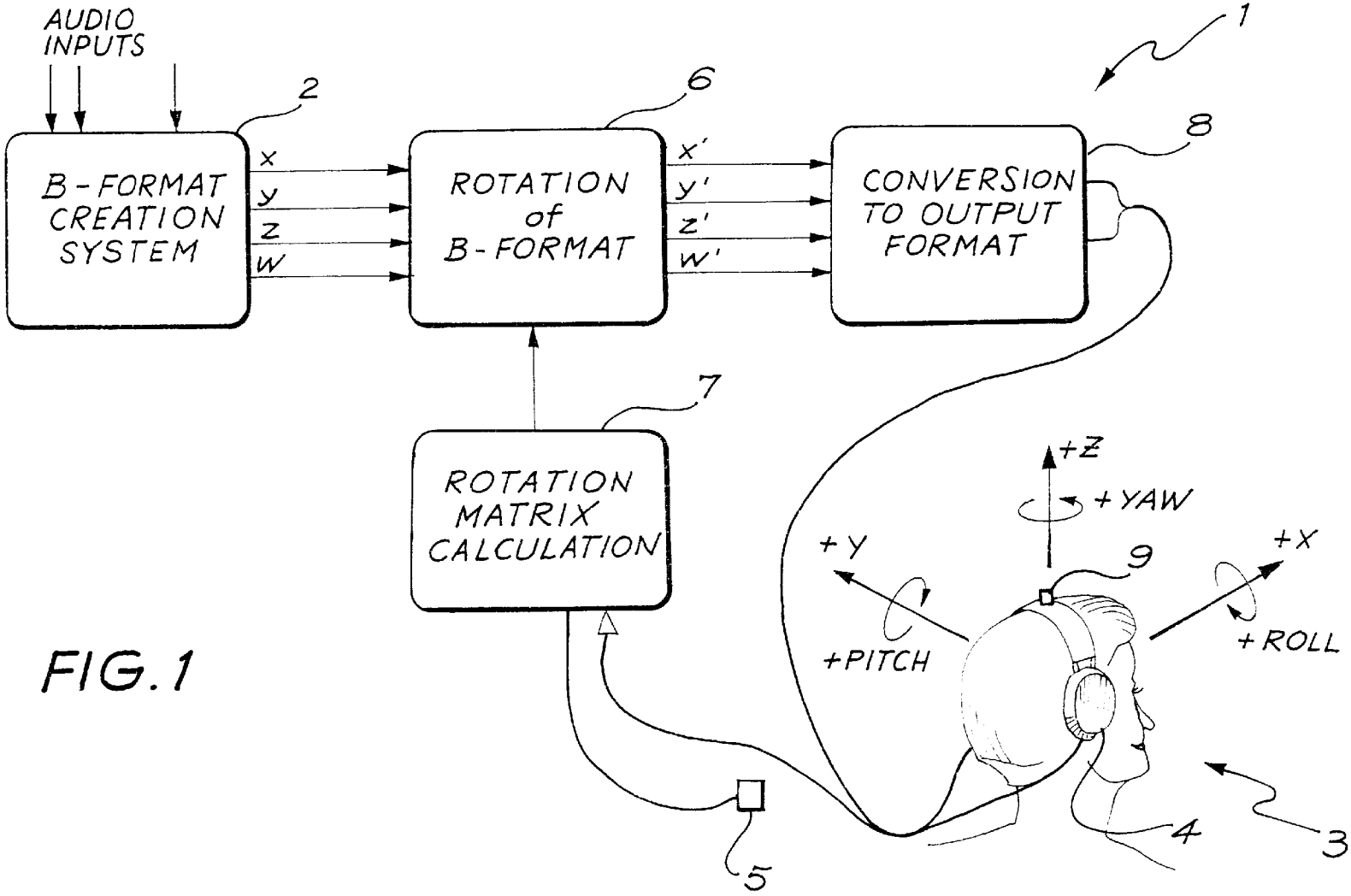
FIG. 1 illustrates in schematic block form, one form of single user playback system.

Referring now to FIG. 1, there is illustrated in schematic form, a first single user system 1. The single user system includes a B-format creation system 2. Essentially, the B-format system 2 outputs B-format channel information (X, Y, Z, W). The B-format channel information includes three "FIG. 8 microphone channels" (X,Y,Z), in addition to an omnidirectional channel (W).

Figure 2:
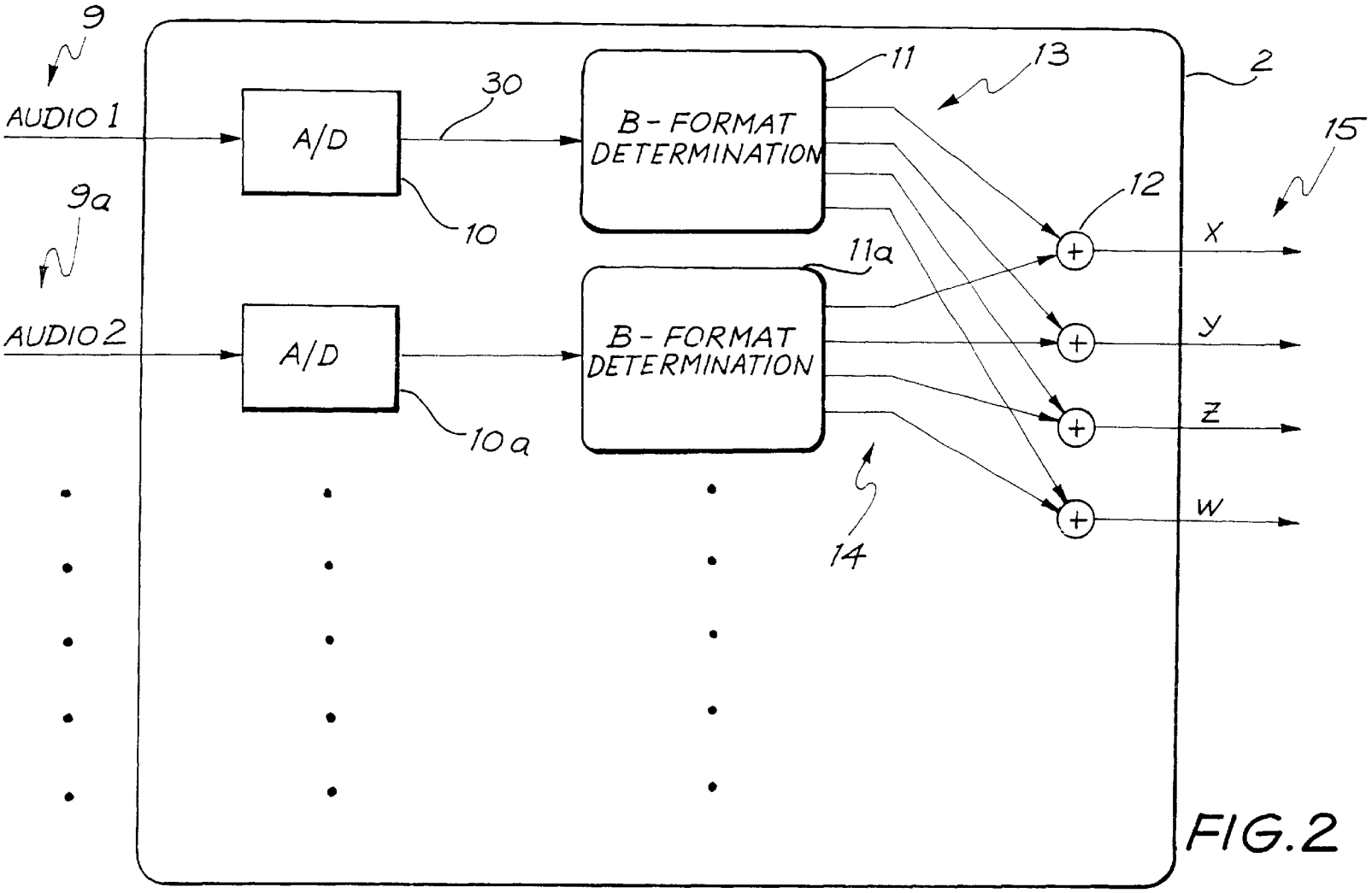
FIG. 2 illustrates, in schematic block form, the B-format creation system of FIG. 1.

Referring now to FIG. 2, there is shown the B-format creation system of FIG. 1 in more detail. The B-format creation system is designed to accept a predetermined number of audio inputs from microphones, pre-recorded audio, of which it is desired to be mixed to produce a particular B-format output. The audio inputs (eg audio 1) first undergo a process of analogue to digital conversion 10 before undergoing B-format determination 11 to produce X,Y,Z,W outputs eg. 13. The outputs are, as will become more apparent hereinafter, determined through predetermined positional settings in B-format determination means 11.

The other audio inputs are treated in a similar manner each producing output in a X,Y,Z,W format from their corresponding B-format determination means (eg 11*a*). The corresponding parts of each B-format determination output are added 12 together to form a final B-format component output eg 15.

Figure 3:
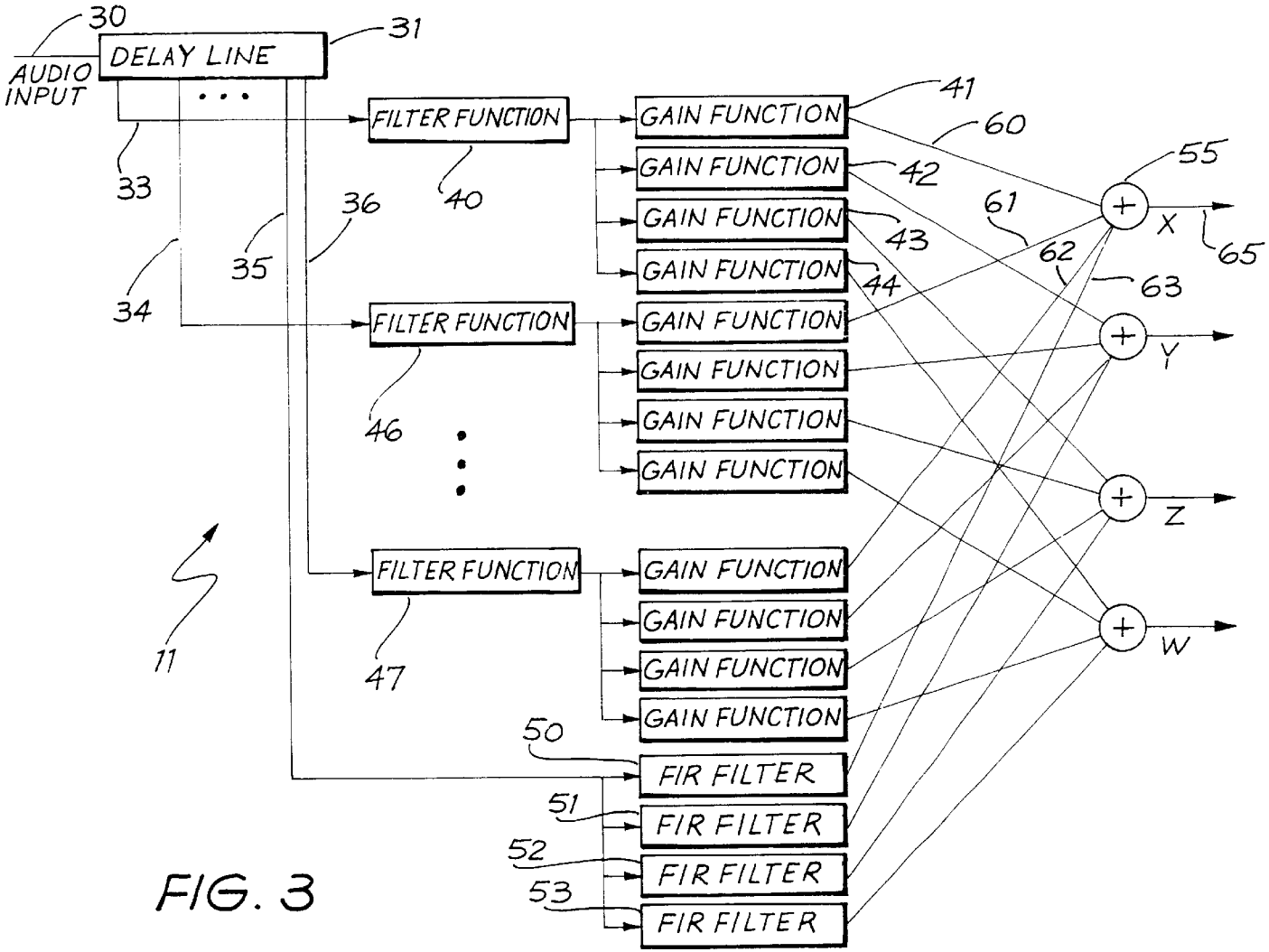
FIG. 3 illustrates, in schematic block form, the B-format determination means of FIG. 2.

Referring now to FIG. 3, there is illustrated a B-format determination means of, eg 11, in more detail. The audio input 30, in a digital format, is forwarded to a serial delay line 31. A predetermined number of delayed signals are tapped off, eg. 33–36. The tapping off of delayed signals can be implemented utilising interpolation functions between sample points to allow for sub-sample delay tap off. This can reduce the distortion that can arise when the delay is quantised to whole sample periods.

A first of the delayed outputs 33, which is utilised to represent the direct sound from the sound source to the listener, is passed through a simple filter function 40 which can comprise a first or second order lowpass filter. The output of the first filter 40 represents the direct sound from the sound source to the listener. The filter function 40 can be utilised to formulate the attenuation of different frequencies propagated over large distances in air, or whatever other medium is being simulated. The output from filter function 40 thereafter passes through four gain blocks 41–44 which allow the amplitude and direction of arrival of the sound to be manipulated in the B-format. The gain function blocks 41–44 can have their gain levels independently determined so as to locate the audio input 30 in a particular position in accordance with the B-format techniques.

A predetermined number of other delay taps eg 34, 35 can be processed in the same way allowing a number of distinct and discrete echoes to be simulated. In each case, the corresponding filter functions eg 46,47 can be utilised to emulate the frequency response effect caused by, for example, the reflection of the sound off a wall in a simulated acoustic space and/or the attenuation of different frequencies propagated over large distances in air. Each of the filter functions eg 46, 47 has a dynamically variable delay, frequency response of a given order, and, when utilised in conjunction with corresponding gain functions, has an independently settable amplitude and direction of the source.

One of the delay line taps eg 35, is optionally filtered (not shown) before being supplied to a set of four finite impulse response (FIR) filters, 50–53 which filters can be fixed or can be infrequently altered to alter the simulated space. One FIR filter 50–53 is provided for each of the B-format components.

Each of the corresponding B-format components eg 60–63, are added together 55 to produce the B-format component output 65. The other B-format components are treated in a like manner.

Referring again FIG. 2, each audio channel utilises its own B-format determination means to produce corresponding B-format outputs eg 13, 14 which are then added together 12 to produce an overall B-format output 15. Alternatively, the various FIR filters (50–53 of FIG. 3) can be shared amongst multiple audio sources. This alternative can be implemented by summing together multiple delayed sound source inputs before being forwarded to FIR filters 50–53.

Of course, the number of filter functions eg 40, 46, 47 is variable and is dependent on the number of discrete echoes that are to be simulated. In a typical system, seven separate sound arrivals can be simulated corresponding to the direct sound plus six first order reflections, and an eighth delayed signal can be fed to the longer FIR filters to simulate the reverberant tail of the sound.

Referring again FIG. 1, the user 3 wears a pair of headphones 4 to which is attached a receiver 9 which works in conjunction with a transmitter 5 to accurately determine a current position of the headphones 4. The transmitter 5 and receiver 9 are connected to a calculation of rotation matrix means 7.

The position tracking means 5, 7 and 9 of single user system was implemented utilising the Polhenus 3SPACE INSIDETRAK (Trade Mark) tracking system available from Polhenus, 1 Hercules Drive, PO Box 560, Colchester, Vt. 05446, USA, Fax: 1 (802) 655 1439. The tracking system determines a current yaw, pitch and roll of the headphones around three axial coordinates.

Given that the output of the B-format creation system 2 is in terms of B-format signals that are related to the direction of arrival from the sound source, then, by rotation 6 of the output coordinates of B-format creation system 2, we can produce new outputs X',Y',Z',W' which compensate for the turning of the listener's 3 head. This is accomplished by rotating the inputs by rotation means 6 in the opposite direction to the rotation coordinates measured by the tracking system. Thereby, if the rotated output is played to the listener 3 through an arrangement of headphones or through speakers attached in some way to the listener's head, for example by a helmet, the rotation of the B-format output relative to the listener's head will create an illusion of the sound sources being located at the desired position in a room, independent of the listener's head angle.

From the yaw, pitch and roll of the head measured by the tracking system, it is possible to compute a rotation matrix R that defines the mapping of X,Y,Z vector coordinates from a room coordinate system to the listener's own head related coordinate system. Such a matrix R can be defined as follows:

$$R = \begin{bmatrix} 1 & 0 & 0 \\ 0 & \cos(roll) & \sin(roll) \\ 0 & -\sin(roll) & \cos(roll) \end{bmatrix} \times \begin{bmatrix} \cos(pitch) & 0 & -\sin(pitch \\ 0 & 1 & 0 \\ \sin(pitch) & 0 & \cos(pitch) \end{bmatrix} \times \begin{bmatrix} \cos(yaw) & \sin(yaw) & 0 \\ -\sin(yaw) & \cos(yaw) & 0 \\ 0 & 0 & 1 \end{bmatrix}$$

The corresponding rotation calculation means 7 can consist of a digital computing device such as a digital signal processor that takes the pitch, yaw and roll values from the measurement means and calculates R using the above equation. In order to maintain a suitable audio image as the listener 3 turns his or her head, the matrix R must be updated regularly. Preferably, it should be updated at intervals of no more than 100 ms, and more preferably at intervals of no more than 30 ms.

The calculation of R means that it is possible to compute the X,Y,Z location of a source relative to the listener's 3 head coordinate system, based on the X,Y,Z location of the source relative to the room coordinate system. This calculation is as follows:

$$\begin{bmatrix} X_{head} \\ Y_{head} \\ Z_{head} \end{bmatrix} = [R] \times \begin{bmatrix} X_{room} \\ Y_{room} \\ Z_{room} \end{bmatrix}$$

The rotation of the B-format 6 can be carried out by a computer device such as a digital signal processor programmed in accordance with the following equation:

$$\begin{bmatrix} X_{head} \\ Y_{head} \\ Z_{head} \\ W_{head} \end{bmatrix} = \begin{bmatrix} & & & 0 \\ & R & & 0 \\ & & & 0 \\ 0 & 0 & 0 & 1 \end{bmatrix} \times \begin{bmatrix} X_{room} \\ Y_{room} \\ Z_{room} \\ W_{room} \end{bmatrix}$$

Hence, the conversion from the room related X,Y,Z,W signals to the head related X',Y',Z',W' signals can be performed by composing each of the $X_{head}$, $Y_{head}$, $Z_{head}$ signals as the sum of the three weighted elements $X_{room}$ , $Y_{room}$, $Z_{room}$. The weighting elements are the nine elements of the 3×3 matrix R. The W' signal can be directly copied from w.

The next step is to convert the outputted rotated B-format data to the desired output format by a conversion to output format means 8. In this case, the output format to be fed to headphones 4 is a stereo format and a binaural rendering of the B-format data is required.

Figure 4:
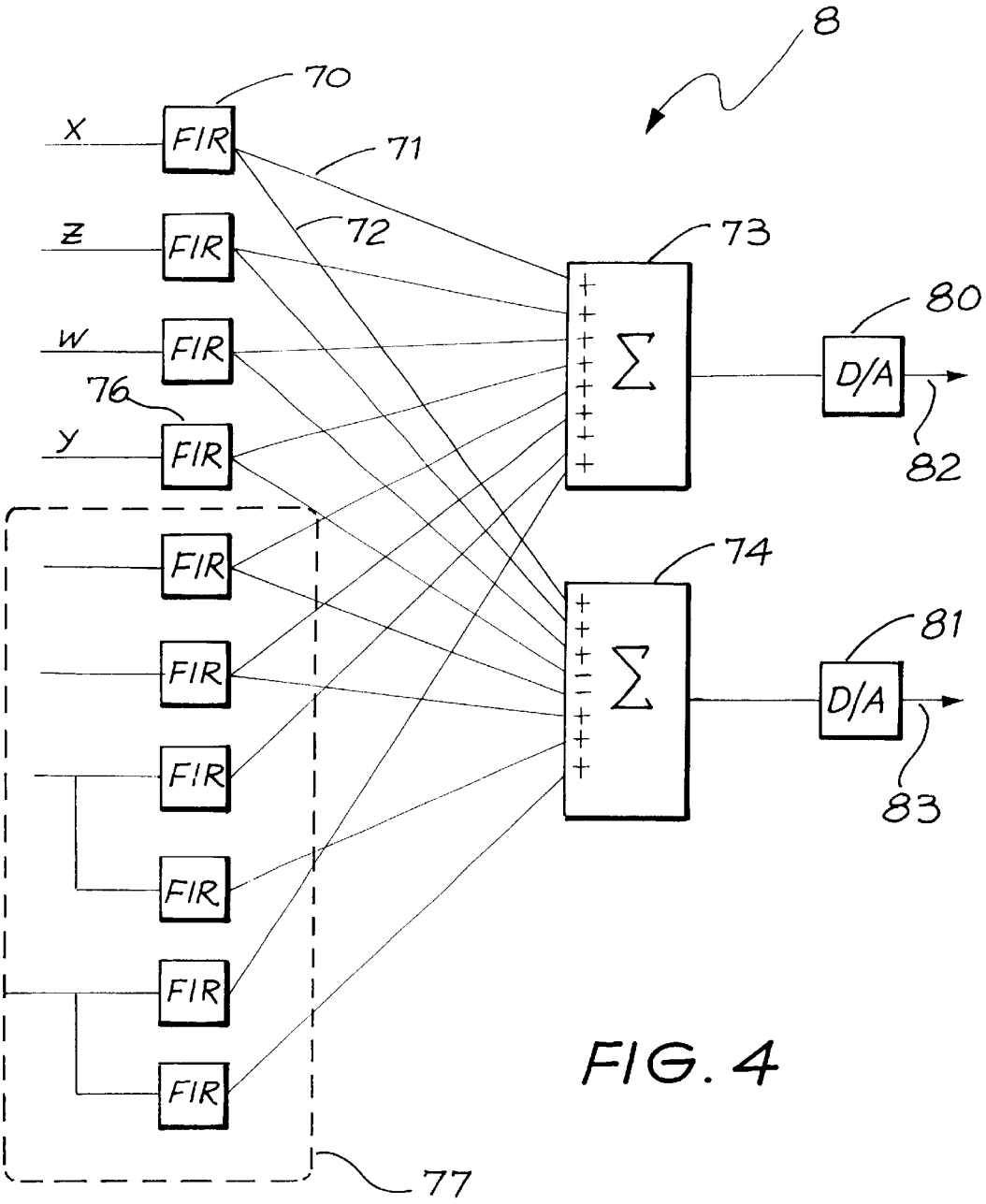
FIG. 4 illustrates, in schematic block form, the conversion to output format means of FIG. 1.

Referring now to FIG. 4, there is illustrated the conversion to output format means 8 in more detail. Each component of the B-format signal is preferably processed through one or two short filtering elements eg 70, which typically comprises a finite impulse response filter of length between 1 and 4 milliseconds. Those B-format components that represent a "common-model" signal to the ears of a listener (such as the X,Z or W components of the B-format signal) need only be processed through one filter each. The outputs 71, 72 being fed to the summer 73, 74 for both the left and right headphone channels. The B-format components that represent a differential signal to the ears of a listener, such as the Y component of the B-format signal, need only be processed through one filter eg 76, with the filter 76 having its outputs summed to the left headphone channel summer 73 and subtracted from the right headphone channel summer 74.

The ambisonic system described in the aforementioned references provides for higher order encoding methods which may involve more complex ambisonic components. These encoding methods can include a mixture of differential and common mode components at the listener's ears which can be independently filtered for each ear with one filter being summed to the left headphone channel and one filter being summed to the right headphone channel. The outputs from summer 73 and summer 74 can be converted 80, 81 into an analogue output 82, 83 for forwarding to the left and right headphone channels respectively.

The coefficients of the various short FIR filters eg 70, 76 can be determined by the following steps:

(1) Select an approximately evenly spaced symmetrically located arrangement of virtual speakers (S1,S2, . . . Sn) around a listener's head.

(2) Determine the decoding functions required to convert B-format signals into the correct virtual speaker signals. This can be implemented using commonly used methods for the decoding of B-format signals over multiple loudspeakers as mentioned in the aforementioned references.

(3) Determine a head related transfer function from each virtual loudspeaker to each ear of the listener.

(4) Combine the loudspeaker decode functions of step 2 and the head related transfer function signals of step 3 to form a net transfer function (an impulse response) from each B-format signal component to each ear.

(5) Some of the B-format signal components have the same, within the limits of computational error and noise factor, impulse responses to both ears. When this is the case, a single impulse response can be utilised and the component of the B-format can be considered to be a common-mode component. This will result in a substantial reduction in complexity in the overall system.

(6) Some of the B-format signal components will have opposite (within the limits of computational error and noise) impulse responses to both ears, and so a single response can be used and this B-field component can be considered to be a differential component.

It should be noted that the number of virtual speakers chosen in step 1 above does not impact on the amount of processing required to implement the conversion from B-format component to the binaural components as, once the filter elements eg 70 had been calculated, they do not require alteration.

Mathematically, the impulse responses for each of the B-format components to each ear of the listener 3 can be calculated as follows:

B-format decode: Impulse response from B-format component i to speaker j=$d_{ij}(t)$ Binaural response of speakers: Response from virtual speaker j to left ear=$h_{j,L}(t)$ Response from virtual speaker j to right ear=$h_{j,R}(t)$ The responses from each B-format component to left and right ears is the sum of all speaker responses, where the response of each speaker is the convolution of the decode function (from the B-format component to the speaker) with the head related transfer function (from the speaker to each ear). This can be expressed mathematically as follows:

$$b_{i,L}(t) = \sum_{j=l}^{n} d_{i,j} \otimes h_{j,L}$$

$$b_{i,R}(t) = \sum_{j=l}^{n} d_{i,j} \otimes h_{j,R}$$

where:$\oplus$ indicates convolution.

The B-format component i is a common mode component if $b_{i,j}(t)=b_{i,R}(t)$.

The B-format component i is a differential component if $b_{i,L}(t)=b_{i,R}(t)$.

The above equations can be utilised to derive the FIR coefficients for the various filters within the conversion to output means 8. These FIR coefficients can be precomputed, and a number of FIR coefficient sets may be utilised for different listeners matched to each individual's head related transfer function. Alternatively, a number of sets of precomputed FIR coefficients can be used to represent a wide group of people, so that any listener may choose the FIR coefficient set that provides the best results for their own listening These FIR sets can also include equalisation for different headphones.

It will be obvious to those skilled in the art that the above system has application in many fields. For example, virtual reality, acoustics simulation, virtual acoustic displays, video games, amplified music performance, mixing and post production of audio for motion pictures and videos are just some of the applications. It will also be apparent to those skilled in the art that the above principles could be utilised in a system based around an alternative sound format having different components.

Further, in accordance with a first embodiment of the present invention the system of FIG. 1 can be extended to multiple users. A first embodiment being especially useful for sound projection in an auditorium environment, such as a movie theatre, will now be described.

Figure 5:
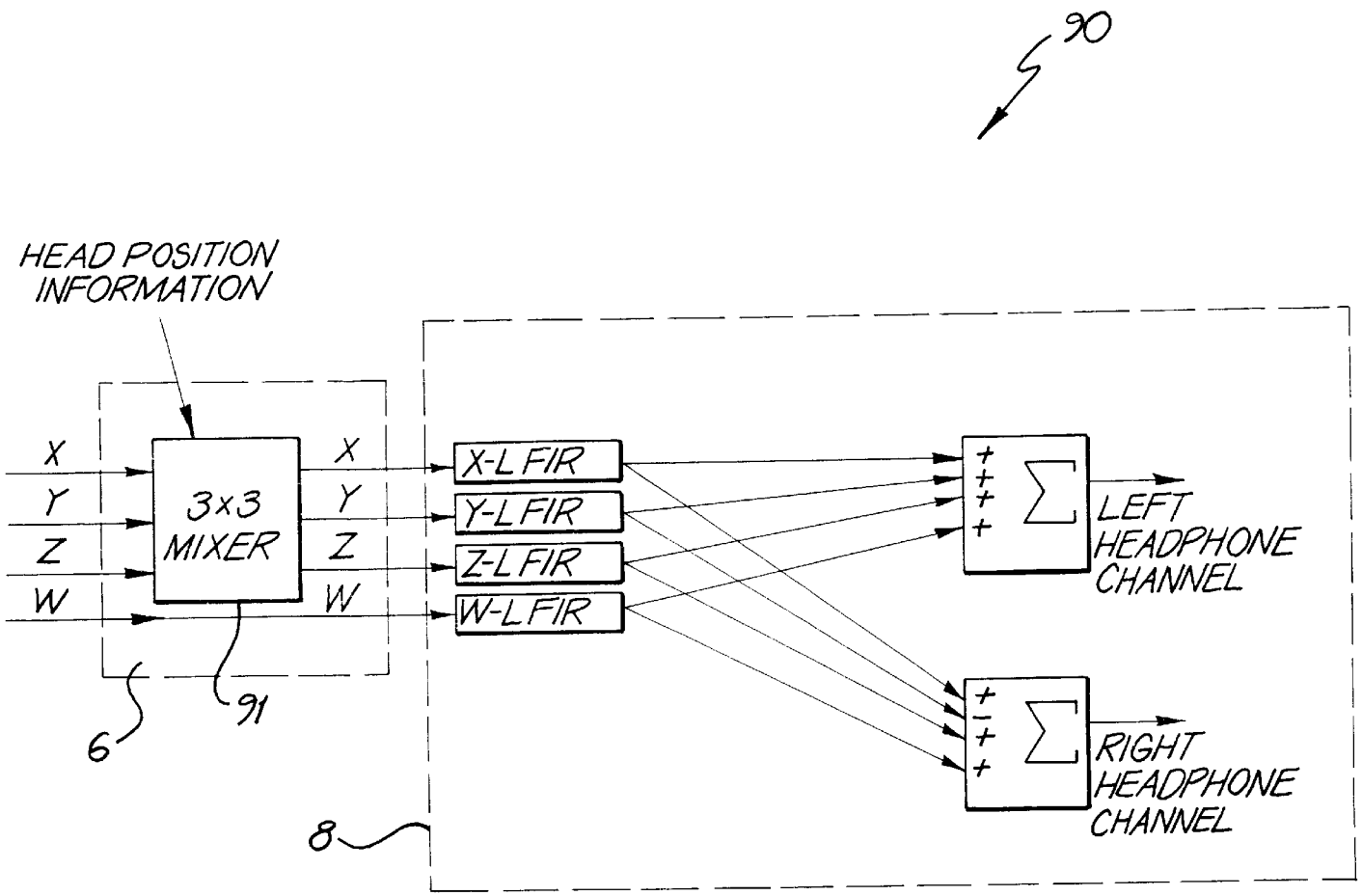
FIG. 5 illustrates in schematic block form, a portion of the arrangement of FIG. 1 in more detail.

Referring now to FIG. 5, there is illustrated 90, in an expanded view, the rotation of B-format means 6 and the conversion to output format means 8 of FIG. 4. As noted previously, the rotation of B-format means 6 can essentially comprise a digital signal processor or program to perform the matrix calculation of equation 2. This is essentially a 3×3 mixing operation with the matrix R providing the head position information for feeding into equation 2.

Often, human listening is much more sensitive to sound movements occurring in the horizontal plane rather than a vertical plane. In this case, the X and Y components are the only components to change and R can be simplified to a 2×2 matrix.

$$\begin{bmatrix} Y_{out} \\ X_{out} \end{bmatrix} = \begin{bmatrix} \cos(yaw) & \sin(yaw) \\ -\sin(yaw) & \cos(yaw) \end{bmatrix} \begin{bmatrix} x \\ y \end{bmatrix}$$

Figure 6:
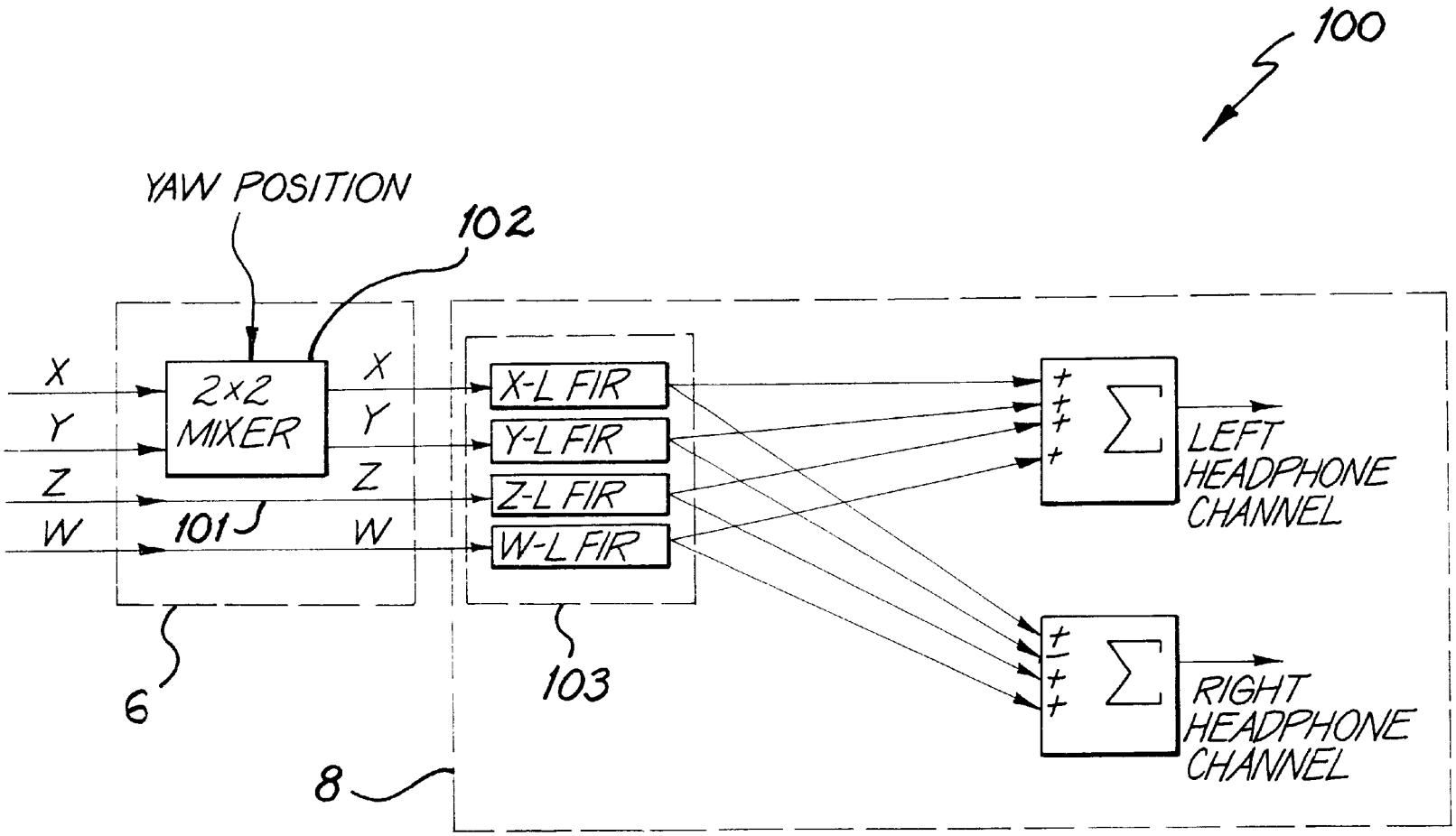
FIG. 6 illustrates in schematic block form, the arrangement of a portion of FIG. 1 when dealing with two dimensional processing of signals.

FIG. 6 illustrates this simplified arrangement 100 of the rotation of B-format means 6 and the conversion to output format means 8 of FIG. 1, wherein the rotation of B-format means 6 does not alter the Z component 101 and includes a 2×2 mixer 102 which carries out the required simplified matrix rotation in accordance with the above equation.

The arrangement 100 of FIG. 6, can be replicated for each user in an auditorium and is user specific. If standard mappings are used for FIR filters, 103, this will result in a replication of the filters 103 for each user. On the other hand, a substantial simplification of the user specific circuitry can be created when filters 103 are moved to a position before the rotation of B-format means.

Figure 7:
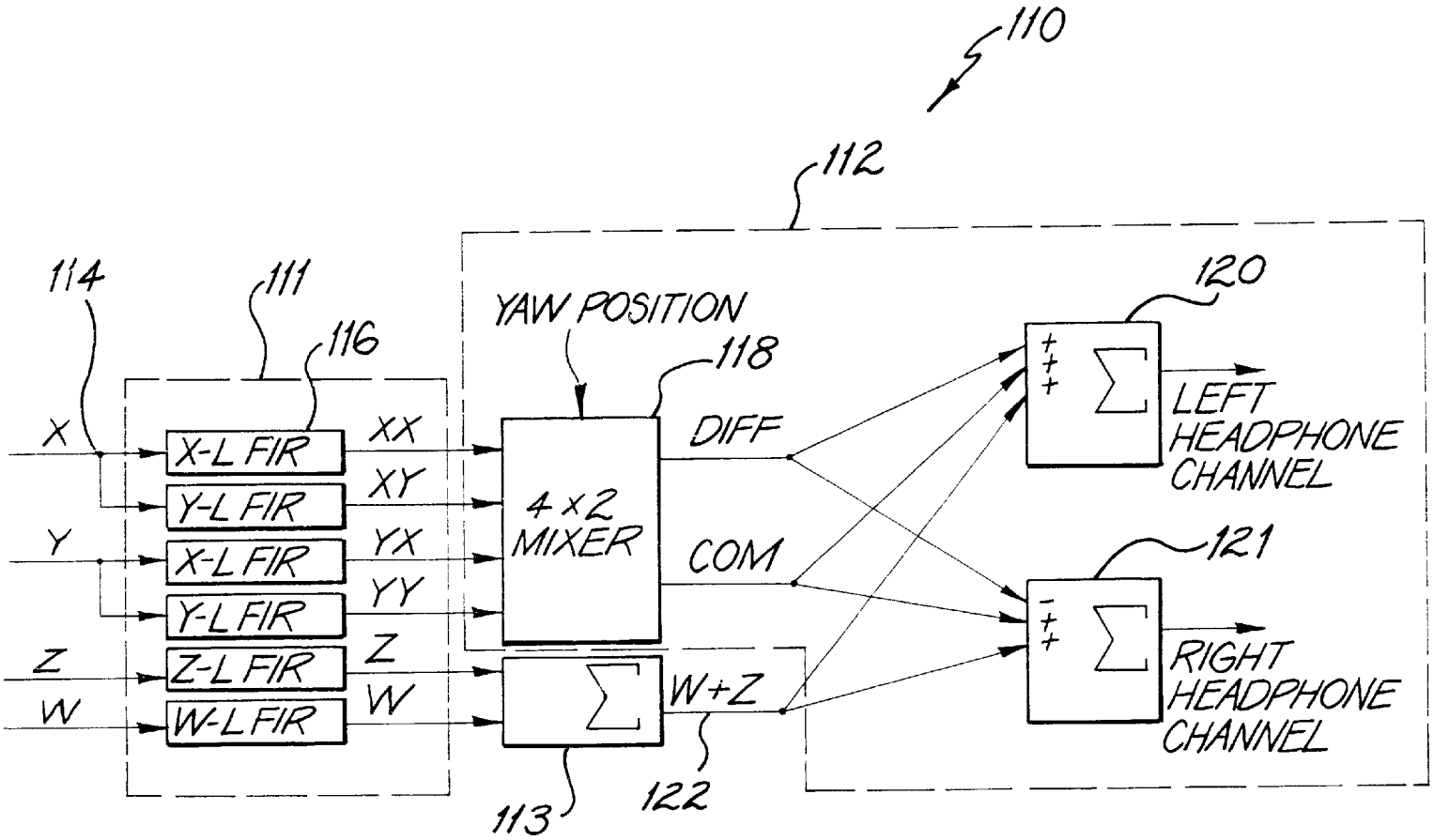
FIG. 7 illustrates in schematic block form, of a portion of a first embodiment for 2 dimensional processing of sound field signals.

Turning now to FIG. 7, there is illustrated one such alternative arrangement. In this arrangement, the response filters 111 have been moved forward of the user specific portion indicated by broken line 112. Therefore, the filters 111 and summation unit 113 need only be utilised once for multiple user outputs thereby realising a substantial saving in complexity of the circuitry for a group of users. Taking the X component input by way of example, it is subject to two finite impulse response filters 116 and 117 to produce output denoted XX (X subjected to the finite impulse response for the head transfer function for X) and XY (the X input subjected to the Y finite impulse response head transfer function). The relevant outputs from the FIR filters are forwarded to a 4×2 mixer 118 which implements the following equation:

$$\begin{bmatrix} Diff \\ Comm \end{bmatrix} = \begin{bmatrix} 0 & -\sin(yaw) & 0 & \cos(yaw) \\ \cos(yaw) & 0 & \sin(yaw) & 0 \end{bmatrix} \begin{bmatrix} XX \\ XY \\ YX \\ YY \end{bmatrix}$$

and produces the differential (Diff) and common (comm) components which are then forwarded to the left and right headphone channel summers 120, 121 in the normal manner in addition to the W and Z components 122 also being forwarded to the summer D. It should be noted in respect of the matrix of equation 7 that a substantial number of terms equal zero. This will result in substantial savings in any DSP chip implementation of equation 7.

Figure 8:
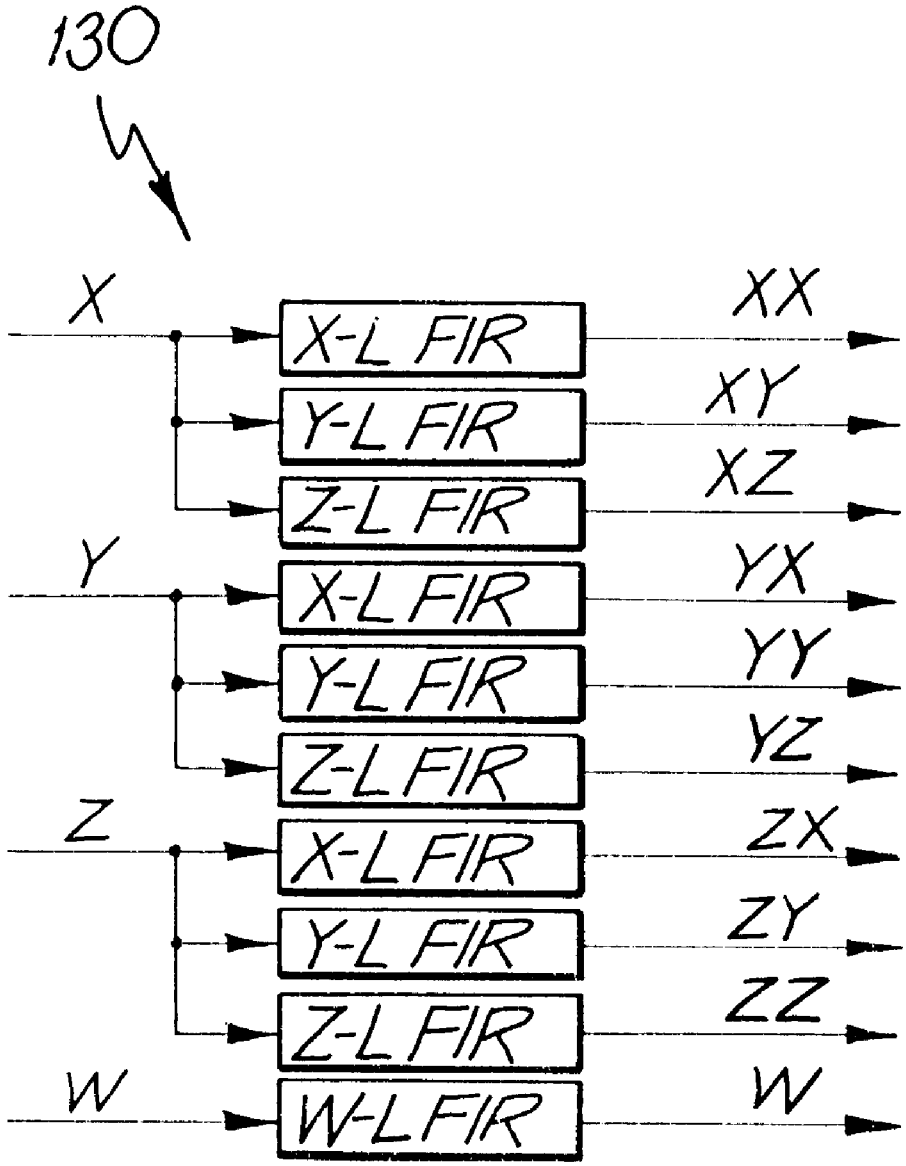
FIG. 8 illustrates in schematic block form, a filter arrangement for use with an alternative embodiment.
Figure 9:
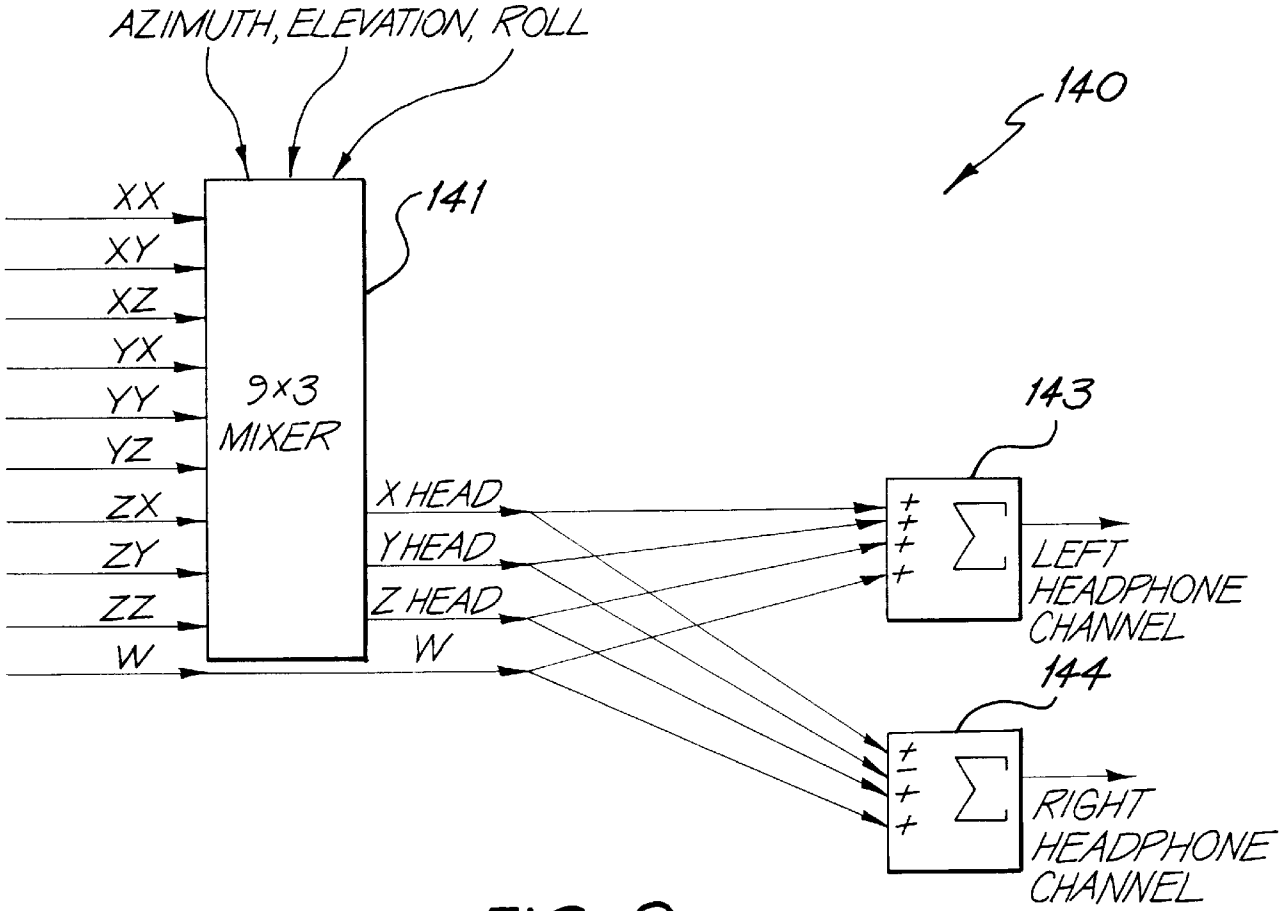
FIG. 9 illustrates in schematic block form, a further alternative embodiment of the present invention.

For a system requiring elevation and roll tracking, the finite impulse response portion becomes larger. However, again only one set of circuitry is needed per group of users. Referring now to FIG. 8, there is shown the finite impulse response filter section 130 for the case of yaw, pitch and roll tracking, having a similar structure to that depicted in FIG. 7 with the added complexity of Z components XZ, YZ, ZX, ZY, ZZ created in the usual manner. Referring now to FIG. 9, there is shown the individual user portion 140 for interconnection with the filter arrangement 130 of FIG. 8. The outputs, apart from the W output of filter section 130 are forwarded to a 9×3 mixer 141 which implements the following equation defined by the following matrix:

$$\begin{bmatrix} X_{head} \\ Y_{head} \\ Z_{head} \\ W_{head} \end{bmatrix} = \begin{bmatrix} cy\cdot cp & 0 & 0 & sy\cdot cp & 0 & 0 & -sp & 0 & 0 & 0 \\ 0 & cy\cdot sr\cdot sp - sy\cdot cr & 0 & 0 & sy\cdot sr\cdot sp + cy\cdot cr & 0 & 0 & sr\cdot sp & 0 & 0 \\ 0 & 0 & cr\cdot sp\cdot cy + sy\cdot sr & 0 & 0 & cr\cdot sp\cdot sy - cy\cdot cr & 0 & 0 & cr\cdot sp & 0 \\ 0 & 0 & 0 & 0 & 0 & 0 & 0 & 0 & 0 & 1 \end{bmatrix} \begin{bmatrix} xx \\ xy \\ xz \\ yx \\ yy \\ yz \\ zx \\ zy \\ zz \\ w \end{bmatrix}$$

where cy=cos(yaw), cp=cos(pitch), cr=cos(roll), and sy=sin(yaw), sp=sin(pitch), sr=sin(roll).

The X, Y, Z and W outputs are then forwarded to left and right channel summers 143, 144 in the usual manner to form the requisite headphone channel outputs. The left and right channel signals are then as follows:

$$\text{left}=X_{head}+Y_{head}+Z_{head}+W_{head}$$

$$\text{right}=X_{head}-Y_{head}+Z_{head}+W_{head}$$

As the $X_{head}$ and $Z_{head}$ signals are the same to the left and right headphones, both these outputs can be combined in an alternative embodiment of mixer 141 which will then become a 9×2 mixer.

For the system tracking yaw position only for a group of users, the complexity of the head tracking arrangement can also be substantially reduced. For example, in a large auditorium, a radio transmitter located near the centre of a stage or viewing screen can be used to transmit a reference signal having a predetermined polarisation which would then be picked up by a pair of directional antennae placed at right angles in the listener's headset. The relative strength of both antennae outputs could be used to determine the listener's head direction relative to the centre stage The five audio channels could then be mixed with inexpensive analogue electronics in a listener's headset to produce the outputs in accordance with the arrangement 112 of FIG. 7

Alternatively, use could be made of the receiving pattern of the receiver in a listener's headset. The five signals (XX, XY, YX, YY, W) can be transmitted into the auditorium having various states of polarisation. The polarisation of the signals and the orientation of the antennae receivers in the listener's headset can then be combined to produce the required signals in accordance with the following equations:

X'=XX cos(yaw)+YX sin(yaw)

Y'=−XY sin(yaw)+YY cos(yaw)

W'=W

Z'=Z

With this arrangement, the various cos and sin functions can be automatically produced as a function of the receiver's reception characteristic to the polarised signals (such as a dipole antenna pattern). Such an arrangement can result in substantial savings in circuit complexity in each receiver's headphones.

Figure 10:
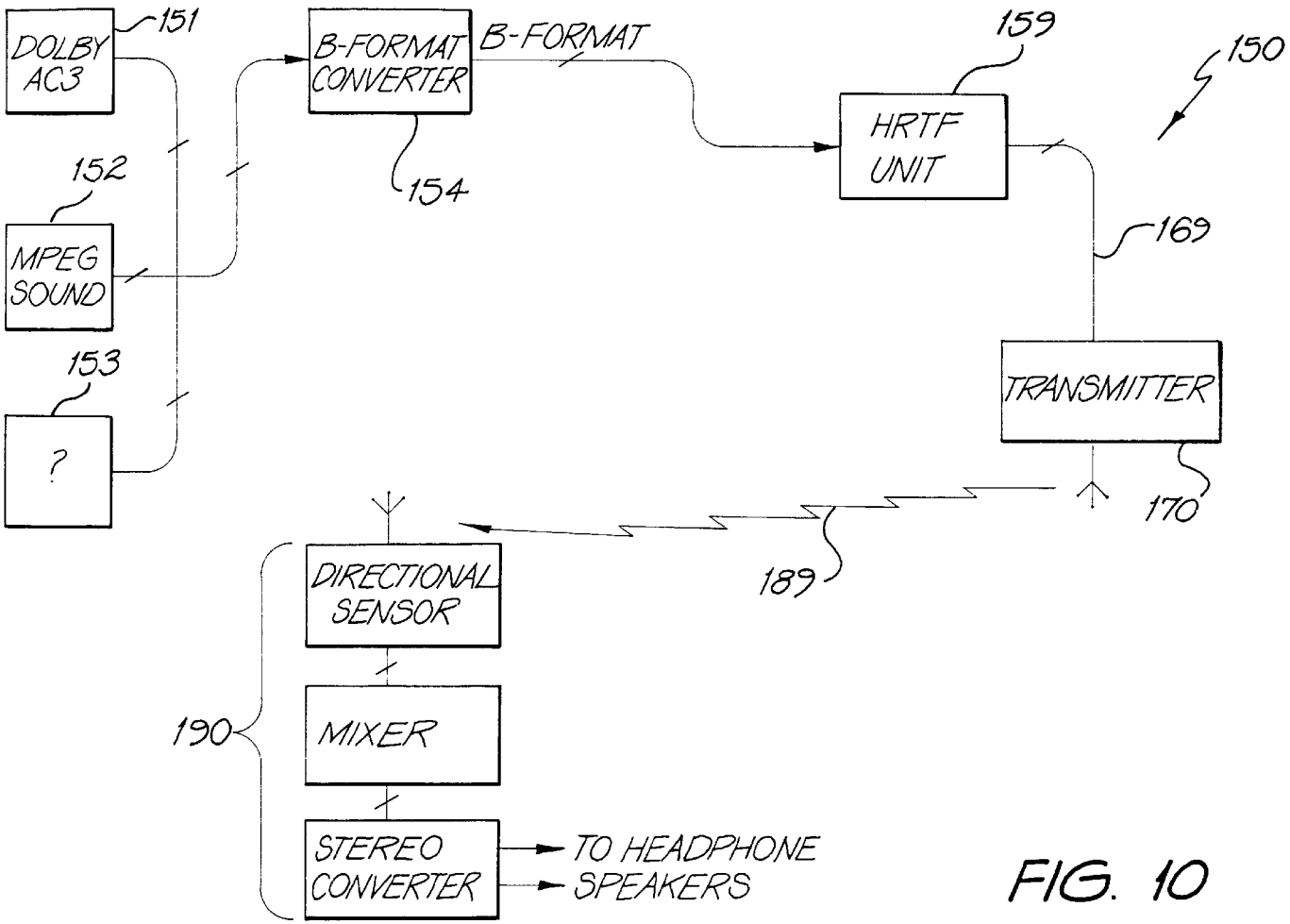
FIG. 10 is a schematic block diagram of a multi user system embodiment of the present invention.

Referring now to FIG. 10, there is illustrated 150 a system for transmitting audio information to a multitude of users The system 150 is designed to take multiple input sound formats. For example, input formats could include Dolby AC3 (151) which is a well known five channel format. Alternatively, the standard sound format defined by the motion pictures expert group (MPEG) 152 could be inputted, in addition to a plurality of other yet to be defined sound formats 153.

Figure 11:
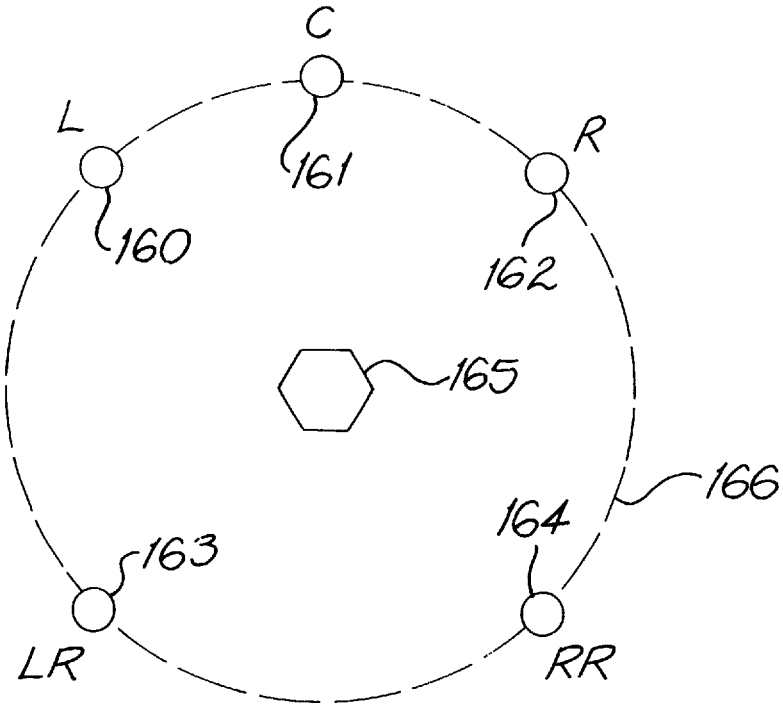
FIG. 11 illustrates the process of conversion from Dolby AC3 format to B-format.

In a first arrangement, the input sound 151 is forwarded to a B-format converter 155 which is responsible for conversion of the sound format from the particular format eg Dolby AC3, to standard B-formatted sound. By way of example, a conversion from the Dolby AC3 format to a corresponding B-format will now be described with reference to FIG. 11. The Dolby AC3 format has separate channels for front left 160, centre 161 and right 162 sound channels, in addition to a left rear channel 163 and a right rear channel 164 and a bass or "woofer" channel W. If it is assumed that the virtual speakers 160–164 are placed around a listener 165 on a unit circle 166 with the channels 160, 162, 163 and 164 being placed at 45° angles, then the B-channel format information can be obtained from the corresponding Dolby AC3 format information in accordance with the following equation:

$$\begin{bmatrix} X \\ Y \\ Z \\ W \end{bmatrix} = \begin{bmatrix} \sqrt{\frac{1}{2}} & 1 & \sqrt{\frac{1}{2}} & -\sqrt{\frac{1}{2}} & -\sqrt{\frac{1}{2}} & 0 \\ \sqrt{\frac{1}{2}} & 0 & -\sqrt{\frac{1}{2}} & \sqrt{\frac{1}{2}} & -\sqrt{\frac{1}{2}} & 0 \\ 0 & 0 & 0 & 0 & 0 & 0 \\ -\sqrt{\frac{1}{2}} & \sqrt{\frac{1}{2}} & \sqrt{\frac{1}{2}} & \sqrt{\frac{1}{2}} & \sqrt{\frac{1}{2}} & \sqrt{\frac{1}{2}} \end{bmatrix} \begin{bmatrix} L \\ C \\ R \\ LR \\ RR \\ Sub \end{bmatrix}$$

Returning now to FIG. 10, the above equation can be implemented by a digital signal processor (DSP) B-format information 156. This method does not add reverberation to the B-format signal (The AC-3 or MPEG signals often already include reverberation).

Alternatively the B-format converter 154 can be produced in accordance with the design of FIGS. 2 and 3.

Next, the output B-format information denoted B-format is forwarded to a head related transfer function unit 159 which corresponds to the unit 111 of FIG. 7. The head related transfer function unit 159 applies the predetermined head related transfer function and outputs 169 the channels XX, XY, YX, YY, Z and W. Of course, the Dolby AC3 format does not include Z component information. Acoustic and reverbation in the B-format convertor 154 may add some Z component. Hence, the Z and W channels can be added together to produce five channels 169 which are then transmitted by FM transmitter 170.

Figure 12:
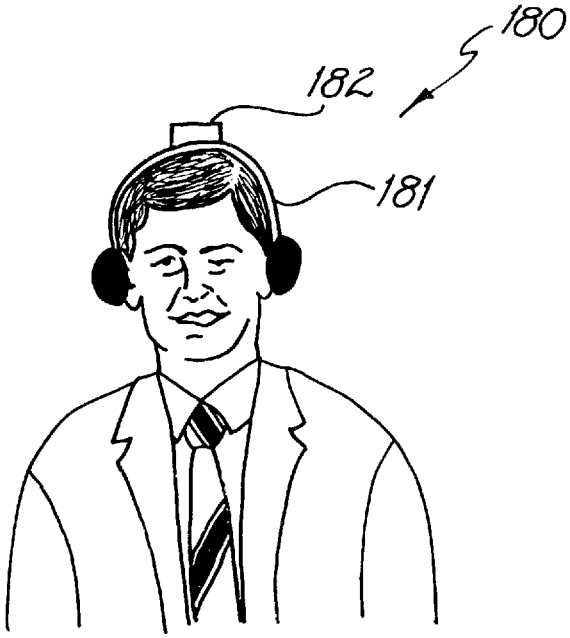
FIG. 12 illustrates the utilisation of headphones in accordance with an embodiment of the present invention.
Figure 13:
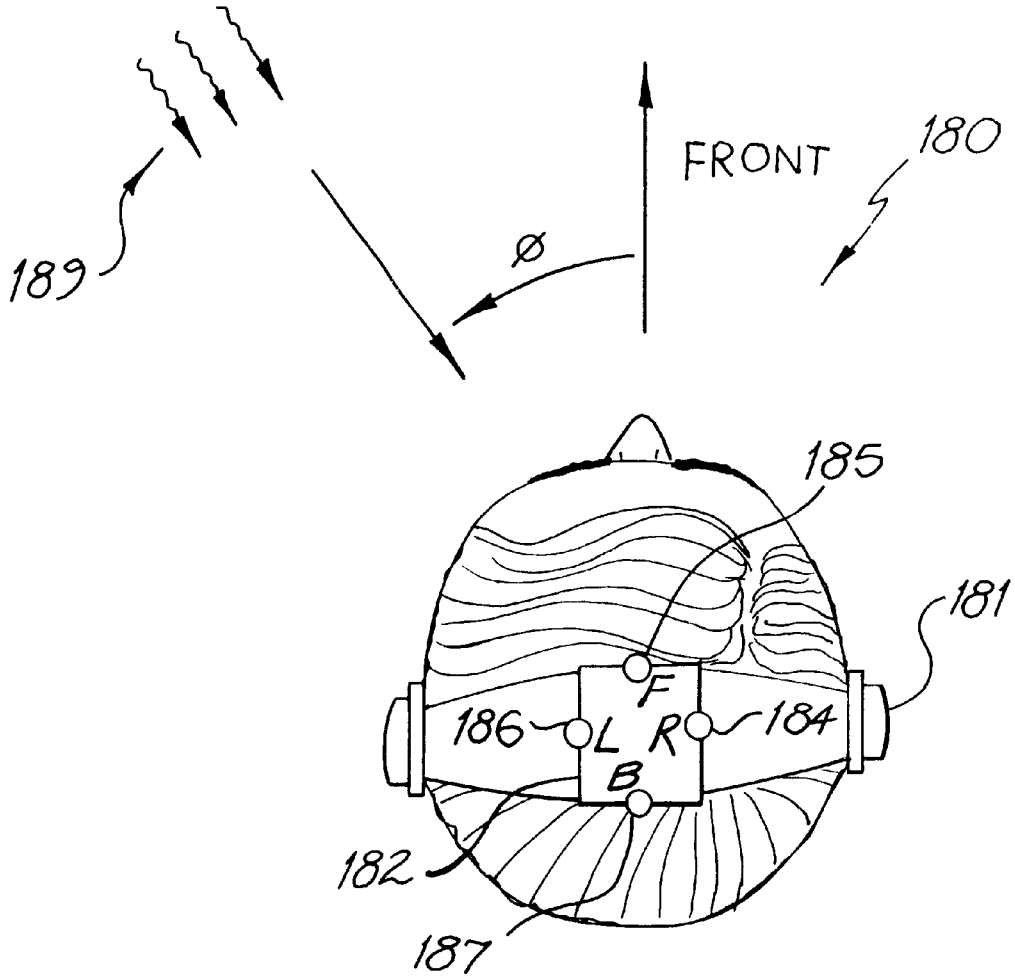
FIG. 13 is a top view of a user's head including headphones.

As discussed previously, many forms of transmission and reception of the five channels are possible. One form of transmission could include infra-red radiation. For example, referring to FIG. 12, a user 180 might utilise a pair of stereo headphones 181 with a mount 182 containing four infra red receivers. Referring now to FIG. 13, there is shown a top view of a user 180, utilising the headphones 181 which include the mount 182 and the four infra red receivers arranged with a right infra red receiver 184, a front infra red receiver 185, a left infra red receiver 186 and a back infra red receiver 187. Each of the infra red receivers are designed to independently receive the five channel signal which is transmitted 189 from a single transmitter 170 (FIG. 10).

Each of the four receivers 184–187will have the following directivity patterns with respect to θ the angle of transmission source:

$$F\ \text{Directivity} = \begin{cases} \cos\theta & (-90° \le \theta \le 90° \\ 0 & \text{otherwise} \end{cases}$$

$$L\ \text{Directivity} = \begin{cases} \cos(\theta - 90°) & 0° \le \theta \le 180° \\ 0 & \text{otherwise} \end{cases}$$

$$B\ \text{Directivity} = \begin{cases} \cos(\theta - 180°) & 90° \le \theta \le 270° \\ 0 & \text{otherwise} \end{cases}$$

$$R\ \text{Directivity} = \begin{cases} \cos(\theta - 270°) & 180° \le \theta \le 360° \\ 0 & \text{otherwise} \end{cases}$$

this directivity information can then be utilised in determining how the five channels should be processed.

Figure 14:
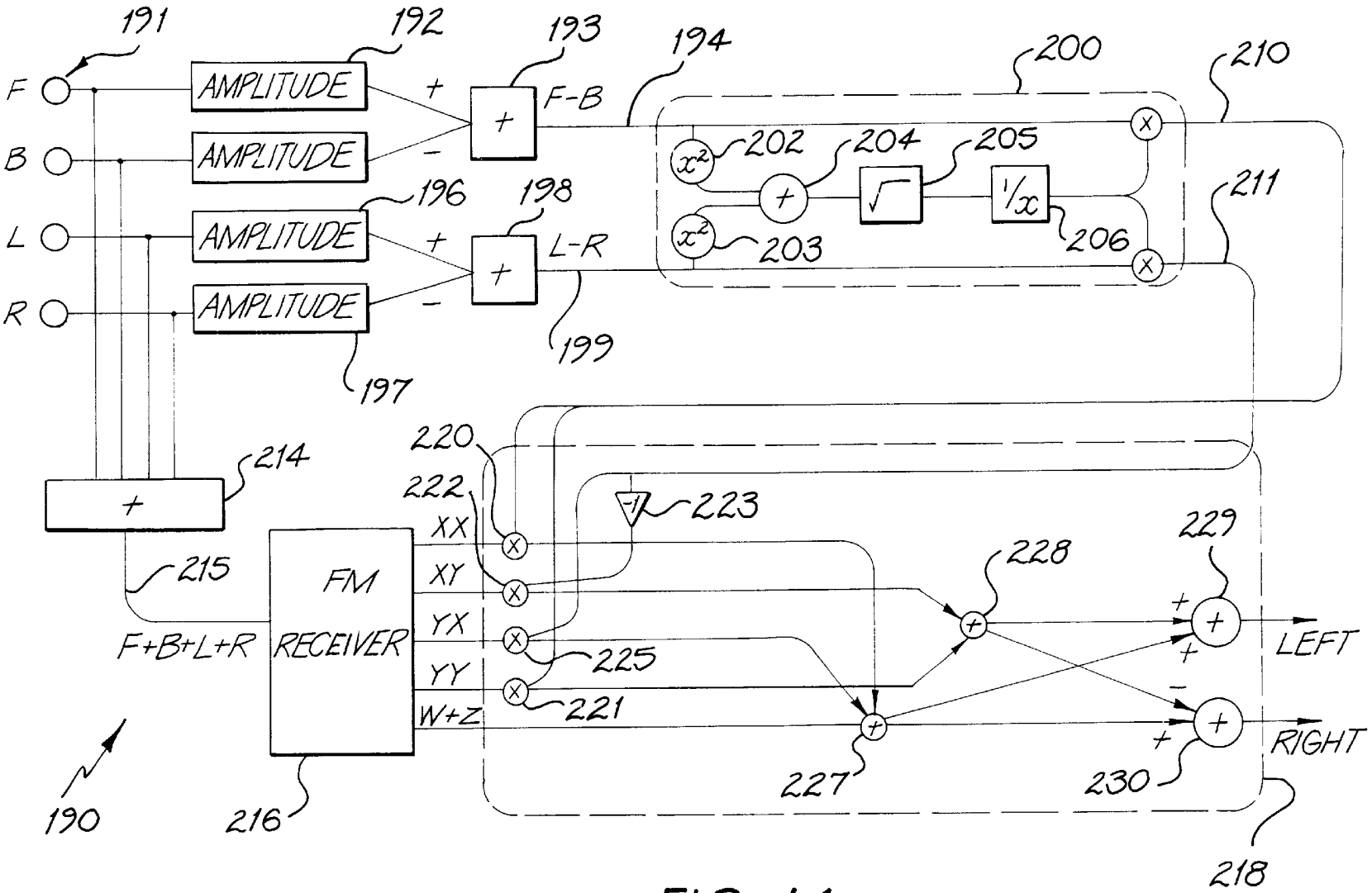
FIG. 14 is a schematic block diagram of a sound signal processing system.

Referring now to FIG. 14, there is illustrated 190 one form of circuitry suitable for use with the headphone arrangement of FIG. 13. The four infra red receiver outputs for the front, back, left and right infra red receivers 184–187 (FIG. 13) are each inputted 191 to an amplitude measurer eg 192 which determines the strength of the received signal. The outputs for the front and back receivers are then forwarded to summer 193 with the output from the back receiver being subtracted from the front receiver so as to produce signal 194 which comprises F-B. Given the aforementioned equations for the directivity of reception of the various receivers, the signal F-B 194 will equal A cos θ, where A is an attenuation factor. This attenuation factor A must be later factored out.

The amplitudes of the left and right receivers are determined e.g. 196, 197 before being fed to summer 198 with the right amplitude being subtracted from the left amplitude to produce signal 199 comprising the left channel minus the right channel. Given the aforementioned equations for directivity of reception, the signal 199 will be equivalent to A sin θ. Again, the factor A of attenuation must be factored out.

In order to factor out the factor A, it is necessary to determine a gain correction factor which can be determined as follows:

$$\begin{aligned} \text{gain correction factor} &= \frac{1}{\sqrt{(F-B)^2 + (L-R)^2}} \\ &= \frac{1}{\sqrt{a^2\cos^2\theta + a^2\sin^2\theta}} \\ &= \frac{1}{a} \end{aligned}$$

The circuitry to implement the above equation is contained within the dotted line 200 of FIG. 14 and includes a squarer 202 and 203 to derive a signal which is the square of the two signals 194 and 199. The output from the squarers 202, 203 is combined 204 before a square root is taken 205, followed by a inverse factor 206. The output from the inverter 206 will comprise the gain correction factor and this is utilised to multiply signals 194 and 199 to produce outputs cos θ (210) and sin θ (211).

Returning to the four inputs 191, the inputs are also forwarded to summer 214 which sums together the four frequency inputs to produce a stronger signal 215. The signal 215 is forwarded to an FM receiver 216 where it is FM demodulated to produce the relevant five channels, XX, XY, YZ, YY, and (W+Z). The five channel outputs and the directional components 210, 211 are then combined within dotted line 218 in accordance with the following equations:

$$L(channel)=W+Z+(XX+YY)\cos\theta+(YX-XY)\sin\theta$$

$$R(channel)=W+Z+(XX+YY)\cos\theta+(YX+XY)\sin\theta$$

The XX output of FM receiver 216 is multiplied 220 by cos θ
as is the YY output 221. The XY output is multiplied 222 by −sin θ, −sin θ having been produced from the sin θ signal 211 by inverter 223. The YX output is multiplied 225 by sin θ. The common components are then added together 227 as are the differential components 228. The two sets of components are then summed together 229 and 230 to create the left and right channels with the differential component 228 being subtracted in summation 230. The left and right channel outputs can then be utilised to drive the requisite speakers.

In this manner, the arrangement 190 can be utilised to directionally sense and process the five channel transmission so as to produce a stereo output which takes on the characteristics of a fully three dimensional sound.

Many alternative embodiments of this system can be readily envisaged. For example, in one such alternative arrangement, recordings could be produced directly in the five channel format (XX, XY, YX, YY, (Z+W)) and transmitted to users having suitable decoders. Hence, in a cinema or the like, the sound track associated with a film may be directly recorded in the five channel format and projected to viewers having corresponding decoding headphones, with each user able to achieve full "3-dimensional" sound listening.

Further, the five channel recordings could easily be created in a different manner. For example the XX, XY, YX, YY etc components could be derived by placing microphones within simulated ears in a recording environment and recording each channel simultaneously.

Of course, alternative embodiments are possible. For example, each user could be fitted out with a full headtracker for producing headtracking information. Alternatively, hall effect electronic compasses could be utilised or other form gyroscopic methods could be utilised.

The foregoing describes various embodiments and refinements of the present invention and minor alternative embodiments thereto. Further modifications, obvious to those skilled in the art, can be made without departing from the scope of the present invention.

What is claimed is:

1. A method for distribution to multiple users of a soundfield having positional spatial components, said method comprising the steps of:

inputting a soundfield signal having the desired positional spatial components in a standard reference frame;

applying at least one head related transfer function to each spatial component to produce a series of transmission signals;

transmitting said transmission signals to said multiple users;

for each of said multiple users:

determining a current orientation of a current user and producing a current orientation signal indicative thereof;

utilising said current orientation signal to mix said transmission signals so as to produce sound emission source output signals for playback to said user.

2. A method as claimed in claim 1 wherein said soundfield signal includes a B-format signal and said applying step comprises:

applying a head related transfer signal to the B-format X component signal said head related transfer signal being for a standard listener listening to the X component signal; and applying a head related transfer signal to the B-format Y component signal said head related transfer signal being for a standard listener listening to the Y component signal.

3. A method as claimed in claim 2 wherein the output signals of said applying step include the following:

XX : X input subjected to the finite impulse response for the head transfer function of X XY: X input subjected to the finite impulse response for the head transfer function of Y;

YY: Y input subjected to the finite impulse response for the head transfer function of Y;

YX : Y input subjected to the finite impulse response for the head transfer function of X.

4. A method as claimed in claim 2 wherein said mix includes producing differential and common components signals from said transmission signals.

5. A method as claimed in claim 3 wherein said applying step is extended to the Z component of the B-format signal.

6. An apparatus for distribution to multiple users of an inputted soundfield having positional spatial components, said apparatus comprising:

head related transfer function application means for applying a head related transfer function to each spatial component to produce a series of outputted transmission signals;

transmmiter means for transmitting said transmission signals to said multiple users;

for each of said multiple users:

receiver means for receiving said transmission signals;

orientation sensor means for determining a current orientation of a current user and producing a current orientation output signal indicative thereof;

sound output means connected to said receiver means and to said orientation sensor means and utilising said current orientation signal to mix said transmission signals so as to produce sound emission source output signals for playback on speakers to said user.

7. An apparatus as claimed in claim 6 wherein said soundfield signal includes a B-format signal.

8. A method for reproducing sound for multiple listeners, each of said listeners able to substantially hear a first predetermined number of sound emission sources, said method comprising the steps of:

inputting a sound information signal;

determining a desired apparent source position of said sound information signal;

for each of said multiple listeners, determining a current position of corresponding said first predetermined number of sound emission sources; and manipulating and outputting said sound information signal so that, for each of said multiple listeners, said sound information signal appears to be sourced at said desired apparent source position, independent of movement of said sound emission sources.

9. A method for reproducing sounds for multiple listeners, each of said listeners able to substantially hear a first predetermined number of sound emission sources, said method comprising the steps of:

inputting a sound information signal;

determining a decoding function for a sound at a desired apparent source position for a second predetermined number of virtual sound emission sources;

determining ahead transfer function from each of the virtual sound emission sources to each ear of a prospective listener;

combining said decoding functions and said head transfer functions to form a net transfer function for a second group of virtual sound emission sources when placed at predetermined positions to each ear of a prospective listener of said second predetermined number of virtual sound emission sources;

applying said net transfer function to said sound information signal to produce a virtually positioned sound information signal; and for each of said multiple listeners, independently determining an activity mapping from said second predetermined number of virtual sound emission sources to a current source position of said sound information signal and applying said mapping to said sound information signal to produce a series of outputs for playback to a current listener.

10. A sound format for utilisation in an apparatus for sound reproduction, said sound format created via the steps of:

determining a current sound source position for each sound to be reproduced;

applying a predetermined head transfer function to each of said sounds, said head transfer function being an expected mapping of said sound to each ear of a prospective listener when each ear has a predetermined orientation.

11. The utilisation of a sound format as claimed in claim 10 comprising:

projecting said sound format to a headphones apparatus utilised by a listener to listen to said sounds, said headphones apparatus including:

directional means for determining a location of said current sound source position relative to a transmission location of said sound format;

reception means for receiving and processing said sound format so as to output said sound having a current sound source position relative to said transmission location, independent of movement of said headphones.

* * * * *

UNITED STATES PATENT AND TRADEMARK OFFICE

CERTIFICATE OF CORRECTION

PATENT NO. : 6,259,795 B1
DATED : July 10, 2001
INVENTOR(S) : David Stanley McGrath It is certified that error appears in the above-identified patent and that said Letters Patent is hereby corrected as shown below:

Column 4,
Line 15, replace "EAQ" with -- FAQ --.

Signed and Sealed this

Twenty-ninth Day of January, 2002

*Attest:*

*Attesting Officer*

JAMES E. ROGAN
*Director of the United States Patent and Trademark Office*